United States Patent [19]

Griesenbeck

[11] Patent Number: 4,590,956

[45] Date of Patent: May 27, 1986

[54] BED TENT

[76] Inventor: Harrell Griesenbeck, P.O. Box 665, Ennis, Tex. 75119

[21] Appl. No.: 604,847

[22] Filed: Apr. 27, 1984

[51] Int. Cl.[4] ..... A45F 1/00

[52] U.S. Cl. ..... 135/116; 135/119; 135/104; 5/113

[58] Field of Search ..... 135/104, 96, 115, 116, 135/102, 106, 119; 5/113

[56] References Cited

U.S. PATENT DOCUMENTS

| | | | |
|---|---|---|---|
| 1,079,757 | 11/1913 | Gould | 135/104 |
| 1,962,918 | 6/1934 | Smith | 135/96 |
| 2,055,044 | 9/1936 | Nelson | 135/104 |
| 2,603,214 | 7/1952 | Taylor | 135/119 |
| 2,820,468 | 1/1958 | Park et al. | 135/96 |
| 3,448,748 | 6/1969 | Walrave | 135/104 |
| 3,619,827 | 11/1971 | Mackenzie | 135/107 |
| 3,751,741 | 8/1973 | Hendry | 135/104 |
| 3,840,919 | 10/1974 | Middleton | 135/96 |
| 3,848,279 | 11/1974 | Ipsen, Jr. | 135/96 |
| 4,251,959 | 2/1981 | Hsu | 135/104 |

*Primary Examiner*—Robert A. Hafer

*Attorney, Agent, or Firm*—Hubbard, Thurman, Turner & Tucker

[57] ABSTRACT

A bed tent comprising a base portion adapted to be snugly fitted over a mattress, a canopy portion connected to said base portion along its lower periphery and adapted to be supported in an upright position so as to provide an enclosure having a bottom surface area that is substantially coextensive with the surface area of the mattress, and an opening for providing ingress and egress by the user.

18 Claims, 6 Drawing Figures

BED TENT

TECHNICAL FIELD

This invention relates to tents, and more particularly, to tents having a bottom portion that is adapted to be fitted over a conventional mattress. The tents of the invention are adaptable for either indoor or outdoor use, and can be employed with any of several types of conventional mattresses, including, for example, innerspring mattresses, foam mattresses, air mattresses, water beds, and the like. The tents of the invention are preferably portable and adapted to be easily erected and collapsed by a single individual.

BACKGROUND ART

Portable tents are well known, and can be used for many different purposes. Tents generally comprise one or more walls adapted to be erected in some fashion so as to create an enclosure for the user. Tents adapted for use outdoors generally comprise a floor or bottom portion adapted to maintain cleanliness inside the tent and to protect the user from the dampness of the underlying earth. Such tents are typically anchored to the earth by means of pins or spikes, and are supported by a network of interconnected poles, rods or braces. Once the user has erected such a tent at the intended use site, cots and/or mattresses are thereafter placed inside the tent for use in sleeping. Although waterproofed canvas has been a frequently used material of construction in years past, a variety of synthetic fibers and reinforced polymeric materials have more recently been used for making such tents.

Tents primarily intended for indoor use are also well known. Such tents are especially popular for use as children's toys and may or may not incorporate a floor or bottom portion. Because tents intended for indoor use cannot generally be anchored to the flooring which supports them, such tents typically comprise a network of frame members that define the perimeter of the tent base in addition to the frame members that are employed to maintain the upper portion of the tent in an upright position.

Another class of conventional enclosures that are frequently referred to as "tents" include oxygen tents, mosquito, and the like that are typically draped over a framework that is either suspended above or supported over the intended user.

Although the conventional tents referred to above have many beneficial advantages, there are numerous other deficiencies and disadvantages that have been encountered during their use. For example, tents adapted for indoor use as children's toys require floor space that may be at a premium, especially in relatively small apartments or residences.

SUMMARY OF THE INVENTION

According to the present invention, a bed tent is provided that comprises an upright canopy portion further comprising an opening for ingress and egress by the user, and a bottom portion that is coextensive with the area covered by the upright canopy portion and is further adapted to engage a conventional mattress.

According to one embodiment of the invention, a bed tent is provided that comprises a tent floor adapted to cover the top surface of a conventional mattress and extend around the sides thereof, and a tent canopy covering an area coextensive with the upper surface of the mattress and connected thereto so as to provide an enclosure having a floor space that is substantially the same as the area of the mattress.

According to another embodiment of the invention, a bed tent is provided that comprises a bottom portion adapted to be fitted around a conventional mattress, and a canopy portion that is adapted to be supported above the bottom portion by a framework comprising diagonally disposed flexible frame members.

According to another embodiment of the invention, a bed tent is provided that comprises interconnected canopy and floor portions, means for maintaining the canopy in an upright position over the floor portion, and means for connecting the floor portion to a conventional cot, bed or mattress, including inflatable mattresses such as water beds or air mattresses.

According to another embodiment of the invention, a bed tent is provided that comprises a bottom portion adapted to serve as a tent floor and also adapted to engage a conventional cot, bed or mattress, and a canopy portion covering an area that is substantially coextensive with the tent floor and that is supported in an upright position by a plurality of collapsible frame members.

According to another embodiment of the invention, a bed tent is provided that comprises a canopy portion and a bottom portion coextensive with the base of the canopy portion that is further adapted to extend around the sides of an underlying bed, cot or mattress and that comprises elastomeric means for removably fastening the bottom portion thereto.

According to another embodiment of the invention, a bed tent is provided that comprises an inflatable, self-supporting canopy that is disposed over and connected to an underlying base portion that is adapted to be fitted over a conventional cot, bed or mattress.

According to another embodiment of the invention, a bed tent is provided that comprises an inflatable base portion, a canopy connected to the base portion that is adapted to be supported in an upright position so as to provide an enclosure over the base portion, wherein the canopy further comprises a doorway for ingress and egress by the user and a plurality of vent holes through the canopy for providing ventilation within the enclosure.

According to another embodiment of the invention, a children's toy is provided that comprises a tent comprising a base portion adapted to be quickly and easily over the mattress portion of the child's bed, a canopy portion disposed over and connected to the base portion so as to form an enclosure over the child's bed, and means for providing ingress and egress by the child.

According to another embodiment of the invention, an oxygen tent is provided that comprises a base portion adapted to be fitted over the mattress of a conventional hospital bed, a canopy portion connected to the base portion by a seam that is adapted to substantially retard the flow of an oxygen-containing gas through the seam, at least one aperture for introducing an oxygen-containing gas into the canopy portion, and means for providing ingress and egress by the user.

According to another embodiment of the invention, a portable bed is provided that comprises a base portion adapted to be fitted around a conventional cot, bed or mattress, and a canopy portion adapted to be supported in an upright position over the base portion to provide an enclosed zone of privacy over the base portion for the user.

According to another embodiment of the invention, a tent bed is provided that comprises a base portion adapted to be fitted around a conventional cot, bed or mattress, and a canopy portion connected to the base portion that is adapted to be supported in an upright position over and coextensive with the base portion, wherein the canopy portion further comprises a woven material adapted to permit the passage of light and air but to prevent the passage of most insects into the enclosure.

The bed tents disclosed herein are a unique means for providing privacy and protection over the bed, cot or mattress of the user. The bed tents of the invention offer an inexpensive and portable method for creating an enclosure over the bed of an individual that takes up minimal space and requires no anchoring beyond the support provided by conventional mattress.

The apparatus of the invention is further described and explained in relation to the drawings and the detailed description set forth below.

THE DESCRIPTION OF THE INVENTION

The description of the invention will be better understood by reference to the following drawings wherein FIG. 1 depicts a perspective view of a preferred embodiment of the bed tent of the invention wherein the door flaps are open to expose a portion of the interior of the tent and wherein the path of the zipper closure for the door flaps is shown in phantom;

Like numerals are employed to designated like members throughout the specification and all figures of the drawings.

DESCRIPTION OF A PREFERRED EMBODIMENT

Referring to FIGS. 1, 2, 5 and 6, bed tent 10 preferably comprises base portion 12 adapted to be fitted over a conventional bed, cot or mattress and canopy portion 14 adapted to provide a substantially upright enclosure over base portion 12. Base portion 12 and canopy portion 14 can be constructed of the same or different materials, depending upon the intended use. When bed tent 10 is intended for interior use as a children's toy, for example, both base portion 12 and canopy portion 14 can be fabricated from conventional cotton sheeting material or the like. Where bed tent 10 is intended for outdoor use, for example, both base portion 12 and canopy portion 14 can be constructed from a water repellant material such as plastic, canvas, impregnated nylon, or the like. Where bed tent 10 is intended for use as an insect barrier, for example, base portion 12 can be constructed from a conventional sheeting material and canopy portion 14 can be constructed from a more loosely woven material that permits the passage of light and/or air but impedes the passage of insects therethrough. When bed tent 10 is intended for use as an oxygen tent in a medical application, for example, base portion 12 can comprise a conventional cotton sheeting material while canopy portion 14 can comprise a polymeric material that is more impervious to the passage of an oxygen-containing gas therethrough.

Figure 5:
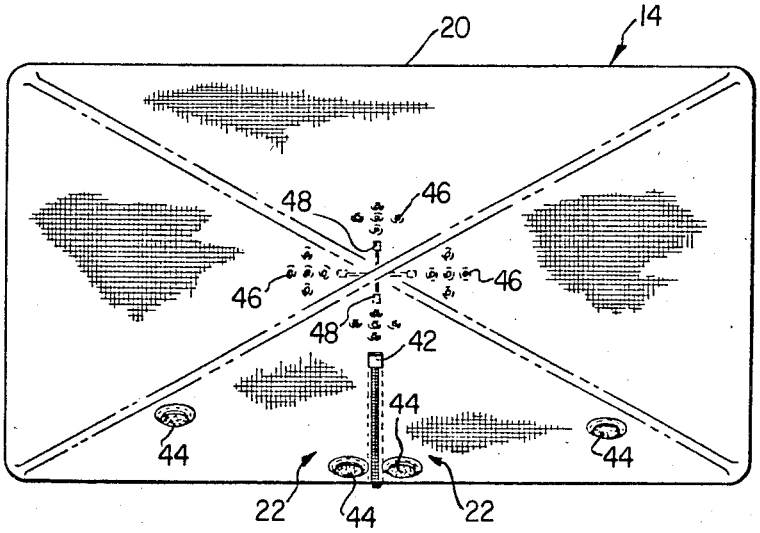
FIG. 5 is a top view depicting the bed tent of FIG. 1 with the door flaps in a closed position.

According to a preferred embodiment of the invention, the lower extending perimeter of canopy portion 14 is coextensive with and connected to the outermost edge 16 of the upwardly extending surface 18 of base portion 12. Canopy portion 14 is preferably connected to base portion 12 by seam 20 which extends around the edge 16 except for that portion of edge 16 which is beneath door flaps 22 of bed tent 10 when door flaps 22 are in their closed position as shown in FIG. 5. The manner in which base portion 12 and canopy portion 14 are connected at seam 20 can vary according to the material that is utilized for the construction of those respective portions, and further depending upon the intended use. Thus, for example, where base portion 12 and canopy portion 14 are both constructed of a conventionnal sheeting material, seam 20 may comprise conventional stitching that is done by hand, a sewing machine, or the like. In this instance, multiple rows of stitching along seam 20 can assist in making the resultant bed tent 10 more durable and serviceable over a prolonged period.

Where base portion 12 and/or canopy portion 14 are fabricated from other materials, seam 20 may be constructed by any suitable fastening means including, for example, heat welding, zippers, rivets, brads, grommets, and the like.

In addition to upwardly extending surface 18, which also serves as a floor for bed tent 10, base portion 12 preferably further comprises sides 24 and bottom edges 26. Bottom edges 26 are preferably gathered at corners 28 and are adapted to be removably fitted around underlying mattress 30 by elastomeric band 32 that may or may not extend continuously around the inward facing perimeter of bottom edges 26. Although the means shown in FIG. 6 for fitting base portion 12 around underlying mattress 30 is a preferred means for use in the apparatus of the invention, other similarly effective means can also be employed within a scope of the invention. Thus, for example, elastomeric straps extending transversely across mattress 30 so as to connect and draw together opposed bottom edges 26 of base portion 12 can also be used where desired.

Similarly, for some applications particularly where bed tent 10 is intended for outdoor use, it may be preferable to reverse base portion 12 with respect to canopy 14 so that the downward facing surface of mattress 30 would be covered by base portion 12 and the upward facing surface of mattress 30 would be partially exposed and would face the interior portion of bed tent 10. This embodiment might be particularly useful where base portion 12 comprises a weather repellent material while mattress 30 does not. In this embodiment, door flaps 22 of canopy portion 14 would have to open sufficiently to permit mattress 30 to be inserted therein so that base portion 12 could thereafter be fitted around mattress 30.

With the preferred embodiment shown in FIGS. 1, 2, 5 and 6, however, bed tent 10 is preferably spread out over mattress 30 prior to erecting canopy portion 14, and bottom edges 26 of base portion 12 are passed over the sides and around the corners of mattress and thereafter maintaining that position by elastomeric band 32 for as long as may be desired.

As stated above, canopy portion 14 is preferably constructed of a material having characteristics that are consistent with the intended use. Thus, where the passage of light and air through canopy portion 14 is desired, a more loosely woven fabric is desirably employed than if the intended function of canopy portion 14 is to repel water or provide more complete privacy for the user.

According to a preferred embodiment of the invention, canopy portion 14 is preferably reinforced at corners 36 to resist tearing of seam 20 at those locations and to provide increased support for the downward extending ends of frame members 38. Corners 36 of canopy portion 14 are desirably reinforced by means of additional layers of a fabric or material that may or may not be the same as that employed as the primary material of construction for canopy portion 14. Additional stitching or other similarly satisfactory means may also be employed for reinforcing corners 36. According to another embodiment of the invention, loops or pockets can also be stitched or otherwise fastened into corners 36 on the interior side of canopy portion 14 so as to assist in maintaining the downward extending portions of frame members 38 in their desired position relative to corners 36.

Figure 1:
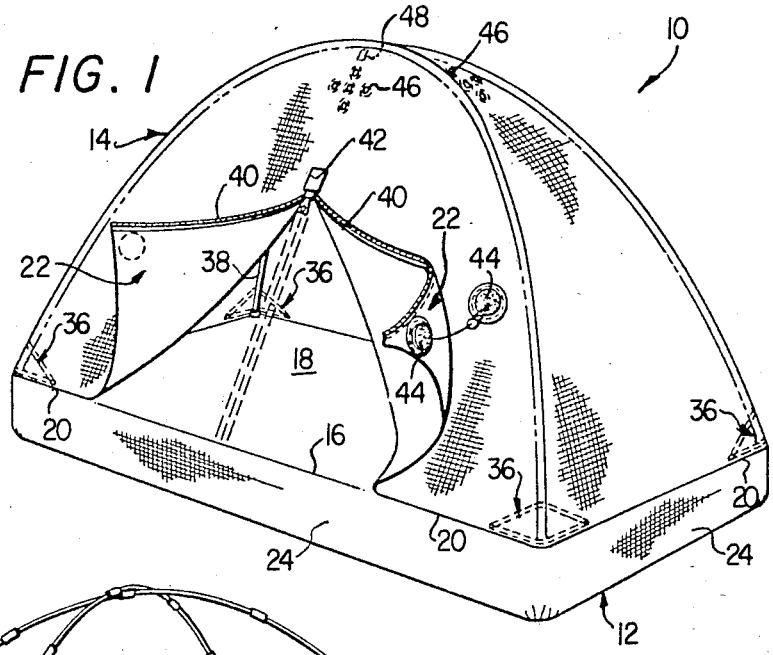

Canopy portion 14 further comprises means for providing ingress and egress to the user. A preferred means of ingress and egress is a zippered closure similar to that depicted in FIGS. 1 and 5 of the drawings. Referring to FIGS. 1 and 5, canopy portion 14 is desirably severed along edges 40, thereby creating door flaps 22. A closed device such as zipper 42 can then be attached to edges 40 of door flaps 22 to permit the user to open and close door flaps 22. Although the zipper shown in FIGS. 1 and 5 is a preferred closure means for use with door flaps 22 of canopy portion 14, it will be apparent that other similarly effective closure devices including, for example, buttons, snaps, Velcro strips, ties, and the like can similarly be employed within the scope of the invention. Velcro pads 44 are provided for maintaining door flaps 22 in their open position when zipper 42 is unzipped. However, other similarly effective means including buttons, snaps, tie backs, and the like can also be employed for this purpose with the apparatus of the invention.

Canopy portion 14 preferably further comprises a plurality of apertures 46 adapted to provide ventilation to and promote air circulation through canopy portion 14. The size, number and placement of apertures 46 can vary according to the material of construction and the intended use. Where the primary material used in the construction of canopy portion 14 is loosely woven, the need for apertures 46 may be alleviated.

Figure 6:
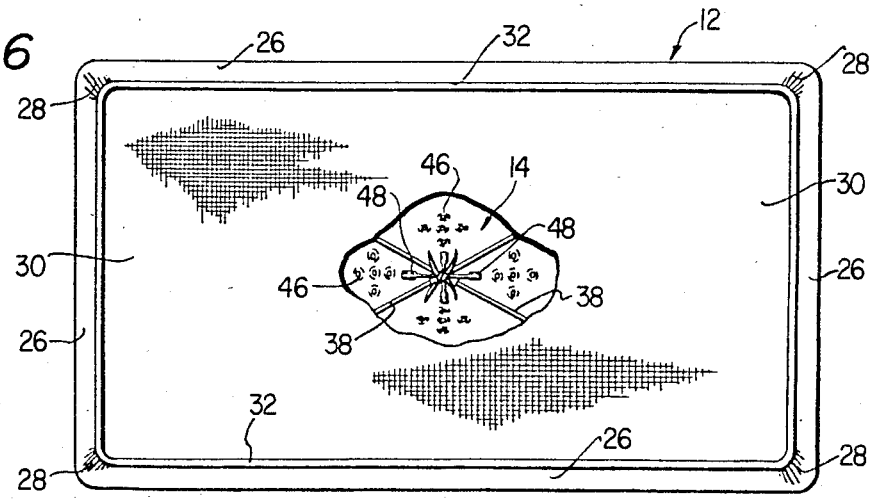
FIG. 6 is a bottom view of the bed tent of FIG. 1 that depicts the manner in which the base portion of the bed tent is fitted around a conventional mattress, and wherein a portion of the mattress is broken away so as to permit viewing of the upper interior portion of the canopy.

Referring to FIGS. 1, 5 and 6, means 48 are also preferably provided within the upper interior portion of canopy portion 14 for use in maintaining the desired positional alignment of frame members 38 with respect thereto. As shown in FIGS. 1, 5 and 6, means 48 comprise ties that are connected to canopy portion 14 by stitching or by some other similarly effective fastening means. Means 48 may not be required where canopy portion 14 is designed and constructed as a self-supporting structure, thereby obviating the need for frame members 38, as discussed below.

Figure 2:
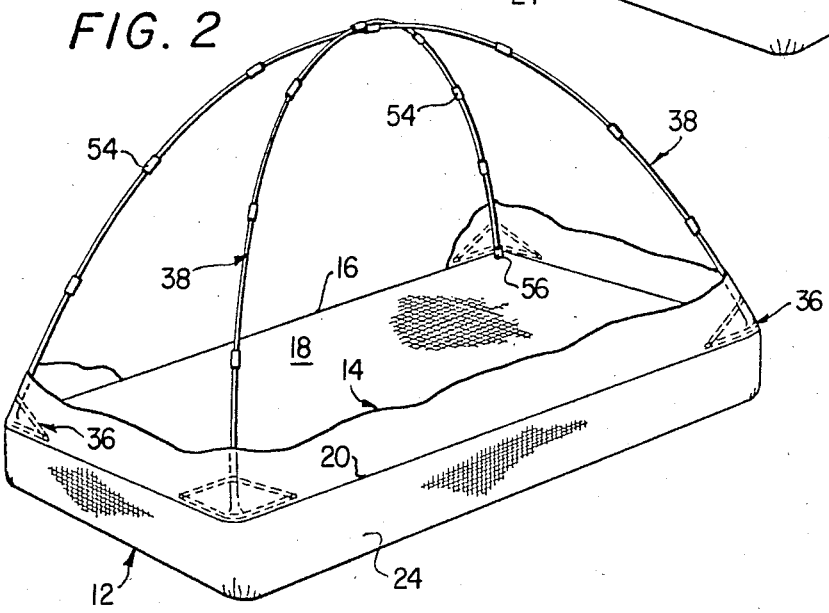
FIG. 2 depicts a rear perspective view of the bed tent of the invention in which the canopy portion is cut away to depict the frame members disposed within the canopy portion that are adapted to maintain it in a substantially upright position over the base portion.
Figure 3:
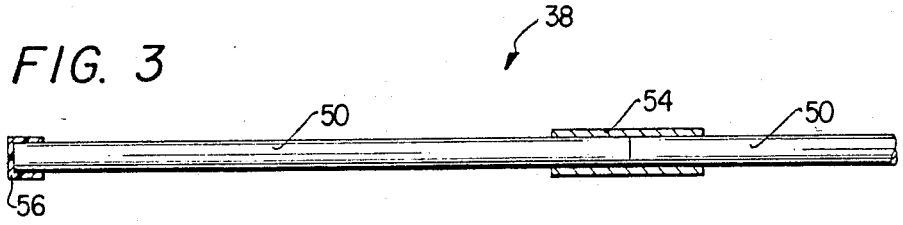
FIG. 3 is a detailed view depicting one end of a frame member suitable for use in supporting the canopy portion of the subject tent bed in a substantially upright position over the base portion.
Figure 4:
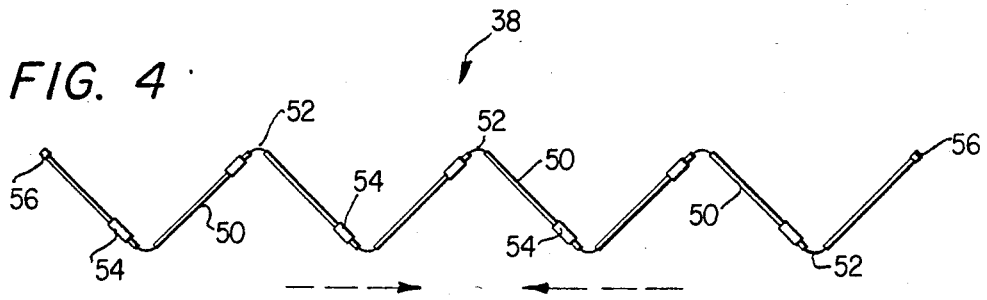
FIG. 4 depicts a preferred frame member for use in supporting the canopy portion of the subject bed tents in a partially collapsed position.

Referring to FIGS. 2, 3 and 4, each of frame members 38 is preferably flexible enough to be easily installed within bed tent 10, but rigid enough to maintain canopy portion 14 in its desired upright position. According to the embodiment of the invention shown in FIGS. 2, 3 and 4, each of frame members 38 further comprises a plurality of tubular fiberglass members 50 that are interconnected by a continuous elastomeric cord 52. Sleeves 54 preferably frictionally engage tubular members 50 to provide a substantially rigid connection between adjacent tubular members 50 whenever frame member 38 is in its extended position. End caps 56 are preferably constructed of rubber, plastic, or the like, and are intended to reduce abrasion or tearing of the material of either base portion 12 or canopy portion 14 at corners 38. Frame members 38 as shown in FIGS. 2, 3 and 4 are preferred for use in bed tent 10 because they are easily collapsible to a length that can be more conveniently packed or carried. Nevertheless, it will be understood and appreciated by those reading this disclosure that flexible vowels, fiberglass rods, graphite rods, metallic rods and the like can also be used with the scope of the invention. Furthermore, where canopy portion 14 is adapted to be self-supporting, the need for frame members 38 can be entirely eliminated. Thus, all or a portion of canopy 14 can be fabricated with a double wall construction that can be inflated by air, or the like so as to make canopy portion 14 self supporting. Thus, canopy portion 14 can be constructed with pneumatically filled ribs adapted to maintain canopy portion 14 in an upright position whenever those ribs are inflated.

Other alterations and modifications of the apparatus of the invention will likewise become apparent to those of ordinary skill in the art having the benefit of the drawings and the description contained herein, and it is intended that the present invention be limited only by the scope of the appended claims.

What is claimed is:

1. A bed tent for providing an enclosure over a conventional mattress comprising:

base means adapted to be removably fitted partially around the mattress and having a surface area sufficient to cover at least one major surface of the mattress, retention means on said base means for engaging only a portion of the underside of the mattress for retaining said base means on the mattress;

canopy means for defining an enclosure above said base means that is coextensive with the upper major surface of the mattress;

means for connecting said base means to said canopy means;

flexible frame members for supporting said canopy means over said base means, said frame members engaging the upper surface of said base means and held in position by said canopy means; and said canopy means further comprising means for providing ingress and egress to the user.

2. The bed tent of claim 1 wherein at least a portion of the bottom edge of said base means further comprises an elastomeric member adapted to snugly secure said base means around said mattress.

3. The bed tent of claim 1 wherein said canopy means further comprises at least one aperture adapted to provide ventilation to the interior portion of said bed tent.

4. The bed tent of clam 1 wherein said frame members further comprise a plurality of diagonally positioned tubular members.

5. The bed tent of claim 1 wherein said frame members comprise a plurality of diagonally positioned, collapsible, segmented tubular members.

6. The apparatus of claim 5 wherein said segmented tubular members are adapted to be connected into a unitary support member by means of sleeves that frictionally engage said segmented tubular members.

7. The bed tent of claim 1 wherein said frame members comprise internally disposed inflatable ribs.

8. A child's toy comprising an enclosure adapted to be erected above a child's bed mattress, said toy comprising base means said base means further comprising fabric adapted to be removably fitted around upper, sides and only a portion of the bottom of the mattress and secured thereto, canopy means connected to said base means and adapted to be maintained in an upright position so as to define an enclosure above the child's bed, flexible frame members for supporting said canopy over said base means, said frame members engaging the upper surface of said base means and held in position by said canopy means and means for providing ingress and egress through said canopy means.

9. The toy of claim 8 wherein said means for ingress and egress further comprises door flaps adapted to be joined by a reversibly engageable fastening means.

10. The toy of claim 9 wherein said canopy means further comprises means for retaining said door flaps in an open position.

11. The toy of claim 8 wherein said canopy means further comprises means for maintaining said frame members in a desired positional alignment interiorly of said canopy means while maintaining said canopy means in an upright position.

12. A bed tent for attachment to a bed mattress having top and bottom major surfaces joined by side surfaces comprising:

a base comprising a single fabric layer multi-sided top portion corresponding in size and shape to the top major surface of the mattress, said top portion having a plurality of corners defined at the intersection of the sides thereof, side portions connected from the top portion and corresponding in size and shape to the sides of the mattress and lip portions connected from each of the side portions, said lip portions for engagement against a portion of the bottom major surface of the mattress, said base, side and lip portions formed of a single fabric layer, elastic retention means cooperating with the lip portions of said base for retaining the lip portions adjacent the bottom major surface of the mattress, a canopy, means attaching said canopy to said base at the corners of the top portion thereof and flexible frame members for supporting said canopy over said base, said frame members engaging the upper surface of the base and held in position by said canopy.

13. The bed tent according to claim 12 wherein said support means comprises a pair of flexible rods diagonally oriented within the canopy with the ends thereof engaged substantially at the corner points of connection of said canopy to said base.

14. The bed tent according to claim 13 wherein said rods cross at substantially the mid points thereof.

15. The bed tent according to claim 13 further comprising:

reinforcement means adjacent the corner points of connection of said canopy to said base for receiving the ends of said rods thereagainst.

16. A method of attaching a canopy over a bed mattress, the mattress having top and bottom major surfaces joined by side surfaces, comprising:

positioning a base over the top major surface and side surfaces of the mattress, drawing the base portion partially around the sides of the mattress to cover a portion of the bottom major surface by use of elastic members attached to the base to bias said base around said mattress, and supporting a canopy over and attached to the base by inserting a pair of flexible rods within the canopy and engaging the upper surface of said base with said flexible rods being held in position by said canopy.

17. The method according to claim 16 further comprising reinforcing the area adjacent the points at which the flexible rods engage the canopy and base.

18. The method according to claim 17 further comprising forming pockets at the points at which the flexible rods engage the canopy and base.

* * * * *